US005312318A

United States Patent [19]

Vernon et al.

[11] Patent Number: 5,312,318

[45] Date of Patent: May 17, 1994

[54] PACKAGING METHOD AND MEANS

[75] Inventors: Geoffrey W. Vernon, Kenilworth; James Goodwin, Coventry; Michael J. Cahill, Kenilworth, all of Great Britain; William M. Buckley, East Sheen, England

[73] Assignee: Thomas J. Lipton Co., Division of Conopco Inc., Englewood Cliffs, N.J.

[21] Appl. No.: 922,598

[22] Filed: Jul. 30, 1992

Related U.S. Application Data

[62] Division of Ser. No. 673,050, Mar. 21, 1991, Pat. No. 5,135,762.

[30] Foreign Application Priority Data

Mar. 21, 1990 [GB] United Kingdom ..... 9006388
Nov. 30, 1990 [GB] United Kingdom ..... 9026122

[51] Int. Cl.[5] ..... B31B 1/64

[52] U.S. Cl. ..... 493/194; 493/223; 493/224; 493/239; 493/201; 493/196

[58] Field of Search ..... 493/194, 195, 196, 197, 493/198, 199, 200, 201, 203, 223, 229, 238, 239

[56] References Cited

U.S. PATENT DOCUMENTS

| | | | |
|---|---|---|---|
| 2,335,159 | 11/1943 | Salflsberg | 229/53 |
| 2,593,608 | 4/1952 | Rambold | 99/77.1 |
| 2,925,171 | 2/1960 | Eaton | 206/0.5 |
| 3,542,561 | 11/1970 | Rambold | 426/79 |
| 3,553,913 | 4/1972 | Rambold | 426/83 |
| 4,055,668 | 10/1977 | Kopp | 426/79 |
| 4,651,870 | 3/1987 | Giambalvo | 206/0.5 |
| 4,786,275 | 11/1988 | Hoover | 493/194 |

FOREIGN PATENT DOCUMENTS

| | | |
|---|---|---|
| 0226133 | 6/1987 | European Pat. Off. . |
| 839405 | 7/1949 | Fed. Rep. of Germany . |
| 2500100 | 12/1979 | Fed. Rep. of Germany . |
| 681816 | 10/1952 | United Kingdom . |
| 870800 | 6/1961 | United Kingdom . |
| 2052428 | 1/1981 | United Kingdom . |
| 2170777A | 8/1986 | United Kingdom . |

*Primary Examiner*—Bruce M. Kisliuk
*Assistant Examiner*—Eileen P. Morgan
*Attorney, Agent, or Firm*—James J. Farrell

[57] ABSTRACT

Twin compartment packets, e.g. tea bags, are formed with the compartments connected at the heads of the packet and optionally at the tails. The packets are produced from a pair of compartmented tubular webs that are brought together with the compartments in register, the webs then being interconnected at the compartment end seals and severed at those seals to form the separate packets. Apparatus for performing the process deposits doses of tea at spaced intervals onto the two separate webs before forming them into the tubular compartmented webs, brings the compartments of the two webs into register, interconnects the registered compartments, and separates the interconnected compartments into individual packets while the web advances continously through the apparatus. The process is capable of high production rates because the webs are able to move through the successive stages at a uniform speed.

17 Claims, 7 Drawing Sheets

PACKAGING METHOD AND MEANS

This is a divisional application of Ser. No. 07/673,050 filed Mar. 21, 1991, now U.S. Pat. No. 5,135,762.

BACKGROUND OF THE INVENTION

This invention relates to packets, particularly but not exclusively to infusion packets containing an infusible material, such as tea bags, especially of the type having an attached string and tag or envelope, and to packaging methods of producing such packets.

Tea bags consist of doses of dried and shredded tea leaves sealed in compartments made of a readily permeable web material, generally referred to as paper although it may have a significant plastics content. The bags may be formed from folded-over tubular lengths of the paper so that each bag has a pair of compartments containing the infusible material one on each side of the fold.

Examples of such twin-compartment bags can be found in GB-A-681816, GB-A-870800, U.S. Pat. No. 2,593,608 and U.S. Pat. No. 2,925,171. These documents also show bags in which a tubular length of the paper is given a W-shaped fold across the middle of its length. As a result of the fold, the two open ends of the tubular length are brought together, and can then receive their doses of tea or other infusible material from twin nozzles inserted then into the open ends to fill both tubular compartments simultaneously, as shown in GB-A-870800. The open ends are typically folded over and closed by being stapled or clipped or heat-sealed together. A tag may be attached to the staple by means of a thread, to make it more convenient for the consumer to handle the bag in use.

It is also known to make tea bags of this twin-compartment form in which the bag has been sealed at the W-fold to close off the compartments from each other.

SUMMARY OF THE INVENTION

In one aspect of the present invention, there is provided a method of producing twin-compartment packets wherein a pair of tubular webs, each divided along its length into a series of discrete compartments, are located in overlapping relationship with their compartments in register, and the webs are joined at the divisions between the compartments. The compartments of the separated packets may be joined at one end only, but it will often be required to join them both at the head and the tail of each packet. In that case, preferably, they are joined at both ends before separating the packets defined by the joined pairs of compartments. In one preferred embodiment, said compartments of each web are partially separated from each other and the overlapping pairs of webs are first connected together at said regions of separation.

In an alternative, the overlapping pairs of compartments are connected together at one end, after which the respective compartments of each pair are folded over in opposite directions about that end connection to bring their opposite ends together, and said opposite ends can then be connected together.

At one said end the compartments may each be provided with a convex or peaked profile edge through which they are joined, and each may be provided at the opposite said end with a concave or centrally recessed profile edge having a pair of laterally outer extensions through which the compartments are joined.

Preferably the compartments are joined together through portions of said extensions which project towards the opposite end of the packet, whereby in the region of said joined extensions the packet is given a generally W-form profile. Said joining may be made through overlapped end portions of said laterally outer extensions, said joined end portions overlapping the centre apex of said profile and extending therefrom towards the outer apices.

The profiles at the two ends of the packet can be complementary so that the compartments can be formed without wastage from a continuous web. The W-form portions which allow for expansion of the contents during infusion but which do not normally carry any of the contents of the packet, can be confined to a considerably smaller area of material than is the case with the known forms of packet referred to above. It is possible therefore to make substantial material savings.

In producing such packets in which the compartments of each web are initially partially separated from each other, the W-folds can be formed in the course of connecting together the regions of partial separation, although the method may also be employed to produce other forms of packet. Preferably, when producing the packets by this method, said partial separation is effected before the two webs are brought together. It is also preferred to seal the compartments from each other before said partial separation, which is then arranged not to impair said seals.

The two tubular webs may be formed from a single web of material which is split in half longitudinally and the two halves then folded longitudinally to give each the tubular form. Alternatively, the two tubular webs may be formed from four narrower webs which are not folded. The four narrower webs may derive from a web of material which is sub-divided.

If a packet is to be provided with a handling thread, which may have a tag on its free end, the other end of the thread can conveniently be attached to the head of one of each pair of compartments prior to their being joined together.

The invention will now be described, by way of example, with reference to the accompanying drawings.

DESCRIPTION OF THE PREFERRED EMBODIMENTS

Figure 1:
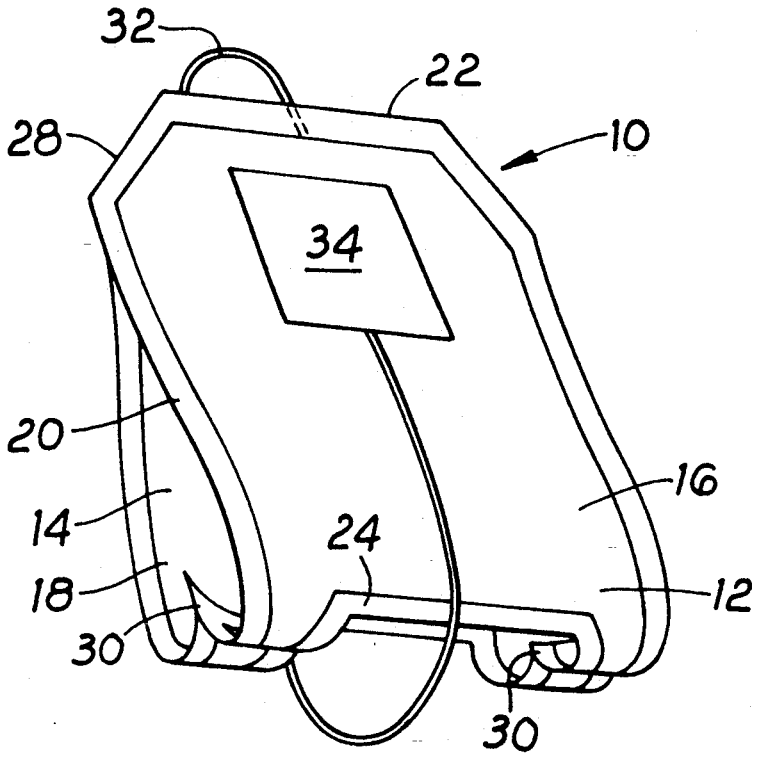
FIG. 1 shows one form of tea bag according to one embodiment of the invention.

Referring to FIG. 1, the tea bag 10 comprises two identical, separate compartments 12,14 joined together at their heads and tails. Each compartment has a pair of opposed walls 16,18 sealed together at their peripheries to form an enclosed space in which has been deposited a dose of tea or other infusible material 46 (FIG. 2).

The edge-sealing of the walls 16,18 is effected by longitudinal edge seals 20 and profile end seals 22,24 at the head and tail respectively of each compartment. The head seal 22 has a convex profile that gives the appearance of cutaway or folded corners 28. This mimics the conventional shape of a double-compartmented tea bag. The tail seal 24 has a concave profile complementary to the profile of the head seal so that it comprises a pair of side extensions 30. Each compartment is folded over on itself so that the joined tail seals 24 of the pair of compartments lie between the compartments, which gives the tail of the tea bag a W-shaped cross-section.

A thread 32 is attached to the tea bag by having one of its ends caught between the joined heads of the compartments. The other end of the thread is attached to a tag 34. For neatness of packaging, the thread may be wrapped around the tea bag and the tag 34 lightly tacked to one face of the tea bag.

Figures 2A, 2B, 2C, 2D:
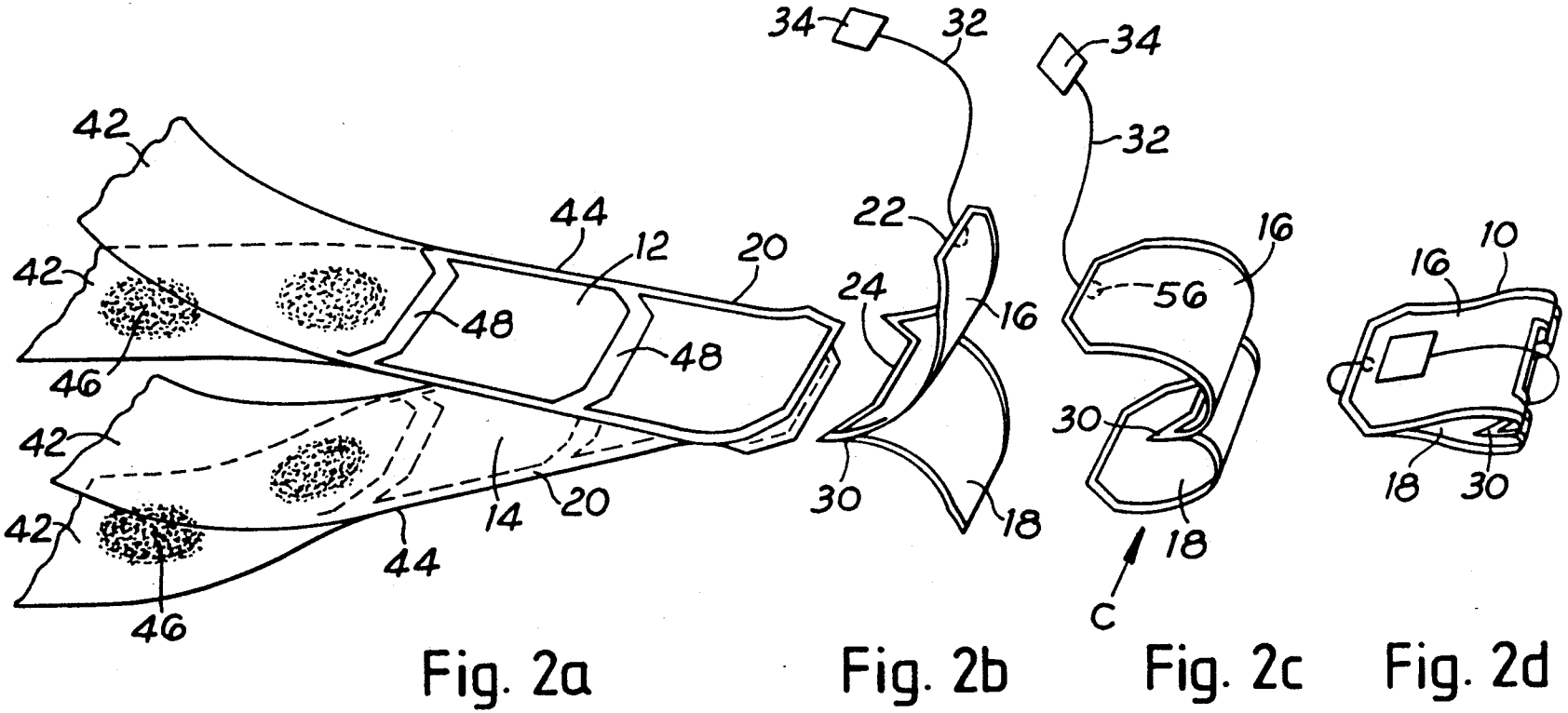
FIG. 2*a–d* gives a schematic representation of a method of making the tea bag shown in FIG. 1.

FIG. 2 shows one method of making the tea bag of FIG. 1. In FIG. 2*a* two pairs of single thickness webs 42, which may be fed from separate reels or slit from a single reel of heat-sealable filter paper, which may suitably be a 15.5 gsm double-sided heat sealable filter paper made by Messrs J R Compton of Bury, Lancashire, and known as "Single Phase Superseal". The single thickness webs 42 are brought together to form two tubular webs 44 by means of the longitudinal heat seals 20. Before the pairs of webs 42 are brought together and their longitudinal edges sealed, doses 46 of tea are placed at spaced intervals on the lower web of each pair. Heat seals 48 are made formed across each tubular web 44 intermediate the tea doses, after sealing the longitudinal edges. These latter heat seals 48 are profiled, to give the cutaway shoulders 28 of the bag shown in FIG. 1.

As a next step the two tubular webs 44 are brought together with the compartments in register. At the tails of the registered pairs of compartments 12,14 a cutting operation is performed within the existing transverse seals 48 to separate the pairs of compartments and divide the seals 48 into the head and tail seals 22,24. Simultaneously, the compartments are welded together at the tail extensions 30 but their heads are left unattached.

As a pair of compartments is so separated, the heads of the compartments are moved apart as shown in FIG. 2*b*, and around towards each other as shown in FIG. 2*c*. The partially completed tea bag assumes a W-form profile as seen edge on, i.e. in the direction C in FIG. 2*c*, with the tail seal 24 located between the main parts of the two compartments. In a final step, the heads of each pair of compartments are brought together and are sealed to each other over the head seals 22.

Between the step of severing a pair of compartments from the webs (FIG. 2*b*) and that of sealing together the two heads of the compartments (FIG. 2*d*) one end of the thread 32 is attached at the head of one of the compartments by a preliminary heat seal or adhesive 56 which is sufficient to retain the thread on the bag until the heads of the two compartments are sealed together to lock the thread firmly between them.

In the initial stages of this process the compartments can alternatively each be formed from a single web that is folded over longitudinally. Spaced tea doses would be dispensed along one half of the web and the second half would then be folded over the tea doses and the free edges heat sealed together to give the web a tubular form.

Figure 3:
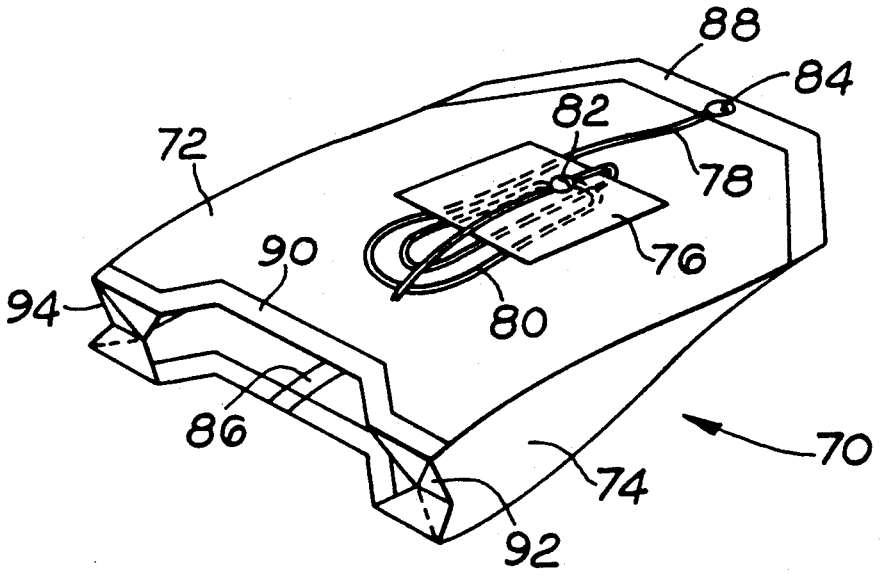
FIG. 3 shows another form of tea bag according to the invention, FIG. 4*a–c* gives a schematic representation of a method of making the tea bag shown in FIG. 3, FIGS. 5 and 6 illustrate apparatus for performing the method shown in FIG. 4*a–c*, the figures showing, respectively the dosing and compartment-forming and the bag assembly stages.

FIG. 3 shows an alternative tea-bag 70 which comprises first and second compartments 72,74, each containing a dose of tea. A tag 76 is attached to the tea-bag and a thread 78 comprising a gathered length or one or more loops 80 held under the tag is secured at one end to the tag by glue spot 82 and at the other to the head or top of the tea bag by glue spot 84. The tag is held releasably in place on the tea-bag by a light heat seal or glue tack (not shown).

The compartments 72,74 have each been produced from a web folded lengthwise to form an elongate tube about the tea doses, the overlapping edges of the folded web being closed together by a butt or lap seal 86. Both seals 86 run along the opposed or inner faces of the two compartments of the tea-bag. The head and tail of each compartment are closed by profiled heat seals 88,90 respectively. These profiled seals are complementary to each other, the head seal 88 being convex and the tail seal 90 being concave as in the first example. The two compartments are sealed together at their heads by a further heat sealing operation overlaid onto the seals 88. At their tails the pair of compartments are connected together only through the tapered side extensions 92 that form the outer parts of the concave profile there. For this connection the side extensions of the two compartments are folded forwards (i.e. towards the head of the bag) to overlap each other and further heat seals are applied to their overlap. In the course of this, a further fold is made at the centre of the overlap of the extensions so that in side view the tail of the tea-bag shows a W-form profile 94.

In this embodiment of the invention, the W-profile can be produced by tucking in, one after the other, the tail portions of each of the compartments of a pair, as shown in FIG. 4, instead of folding over the compartments as in FIGS. 1 and 2. This allows the partly formed tea bags to move continuously forwards along a travel path as they are brought together and the W-profile formed and the heads of the compartments are connected together (whether before or after the tails), which makes a faster production rate possible.

Figure 4C:
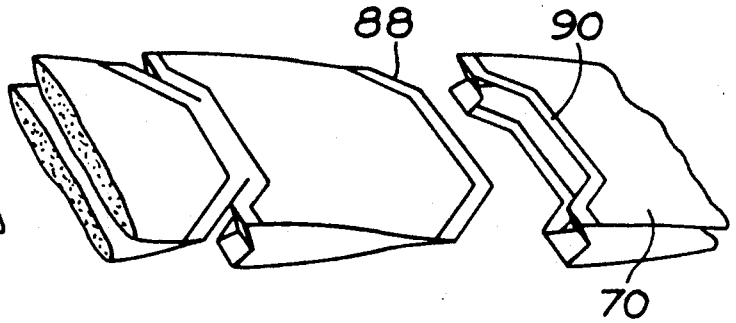
Figure 4B:
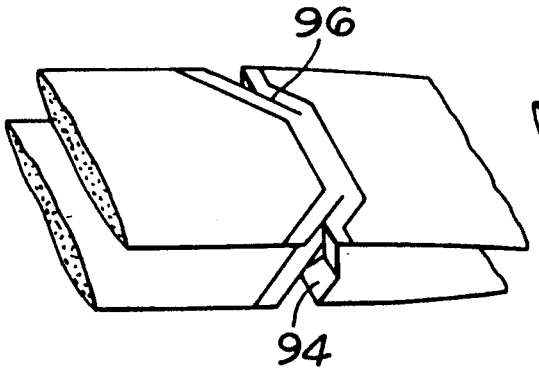
Figure 4A:
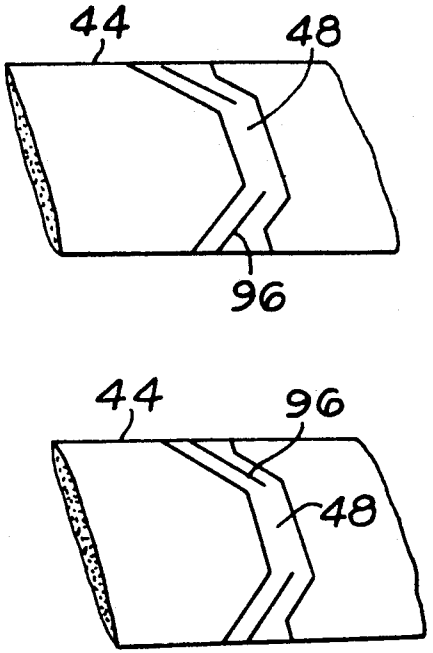

In the method illustrated in FIG. 4, the dosed and compartmented tubular webs 44 are partially severed by a pair of cuts 96 in the inclined side portions of each heat seal 48 (FIG. 4*a*). The webs are brought adjacent to each other, with their compartments in register and the tail portions of each compartment at the cuts are bent inwards towards each other. These portions heat sealed together and folded in to give the W-form profile 94 at each side (FIG. 4*b*). The pairs of compartments can now be sealed together at their heads and the cuts in the heat seals 48 completed to sever the dual-compartment tea bags from the webs, leaving each pair of compartments with the joined head seal 88 and separate tail seals 90 (FIG. 4*c*). An example of the apparatus by means of which this method can be carried out is shown in FIGS. 5 to 8.

Figure 5:
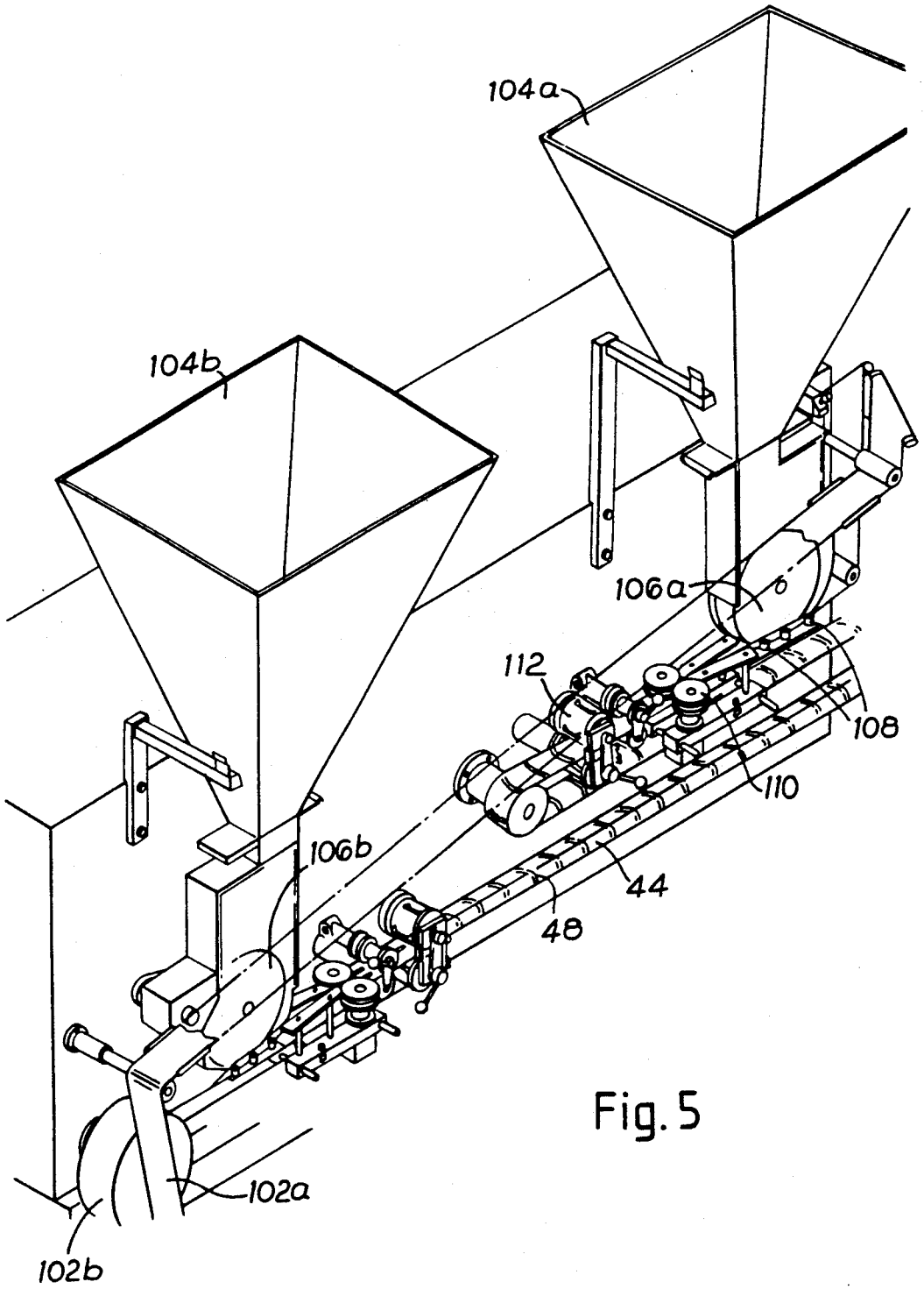

In FIG. 5, two webs 102*a*,102*b* of filter paper are shown travelling through the apparatus, each of which is to form a compartmented tubular web 44. Although not shown, one of the webs may be provided with the thread and tags shown on the tea bag of FIG. 3. Each web travels under a respective tea hopper 104*a*,104*b* and in close contact with a dosing wheel 106*a*,106*b* fed from the hopper to receive the doses of tea contained in pockets (not shown) in the periphery of the wheel.

In this example, the two webs are formed from a single reel of double-width material (not shown) and the arrangement of rollers through which one of the webs passes is designed to ensure that the tea doses are deposited on the same face of each web, for example, that which lies outermost when the material is on the reel. The processes through which the two webs go through in the apparatus shown in FIG. 5 are otherwise identical and the treatment of only the web 102*a* will therefore be described.

The dosing wheel 106*a* is narrower than the web and with the aid of guide rollers 108 the sides of the web begin to fold upwards as a first step in forming the tube 44 in which the opposite edges of the web are sealed together. This tube forming operation can be carried out in generally known manner by folding the sides of the travelling web around a fixed shoe (not visible) and passing the overlapped side edges through seam sealing rollers 110.

After the longitudinal heat seal is made with the seam rollers 110 the web passes between a pair of rollers 112 which make profiled dividing seals 48. The rollers 112 are synchronised with the dosing wheels 106 so that the seals 48 are placed between successive tea doses.

Figure 6:
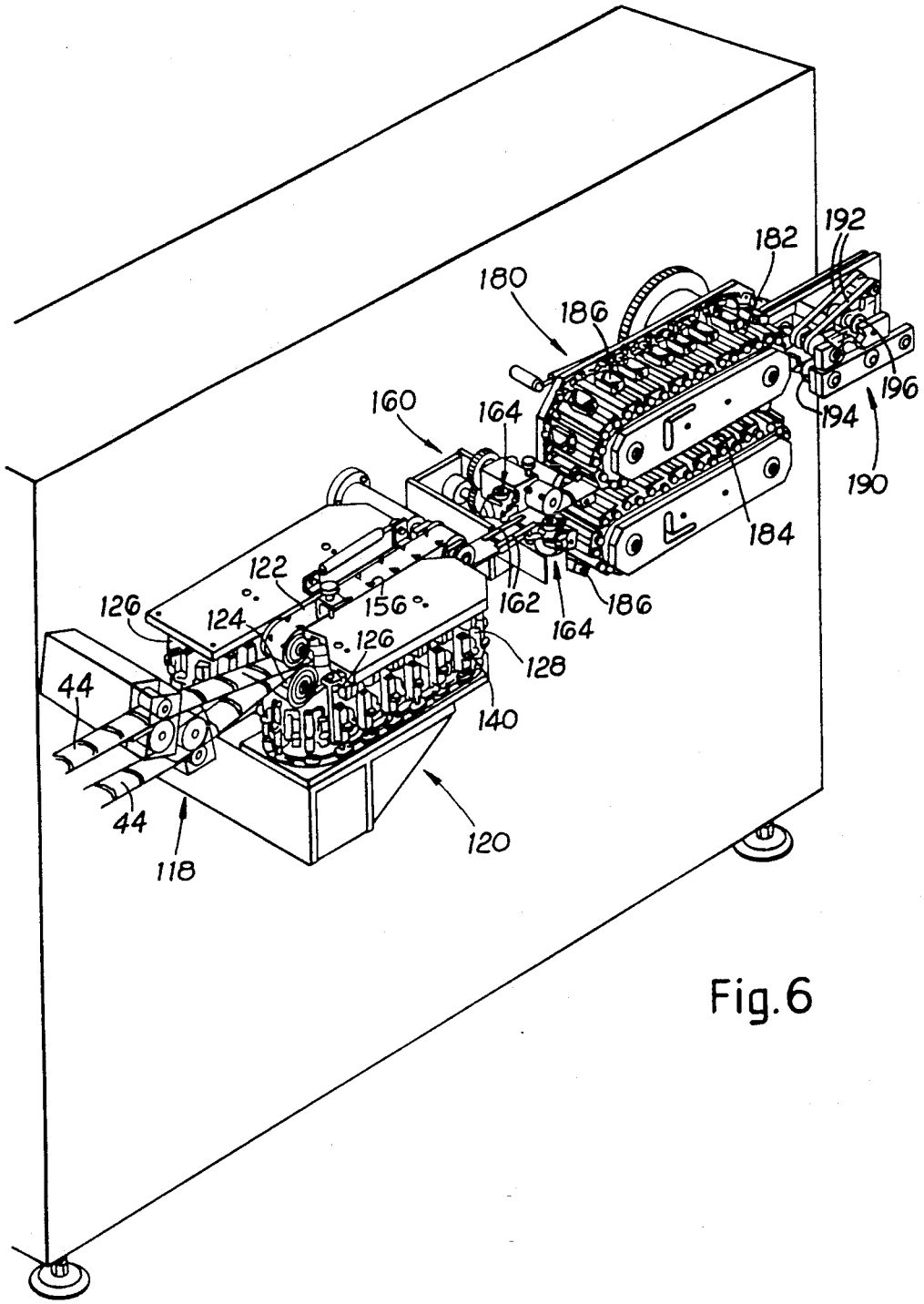
Figure 7:
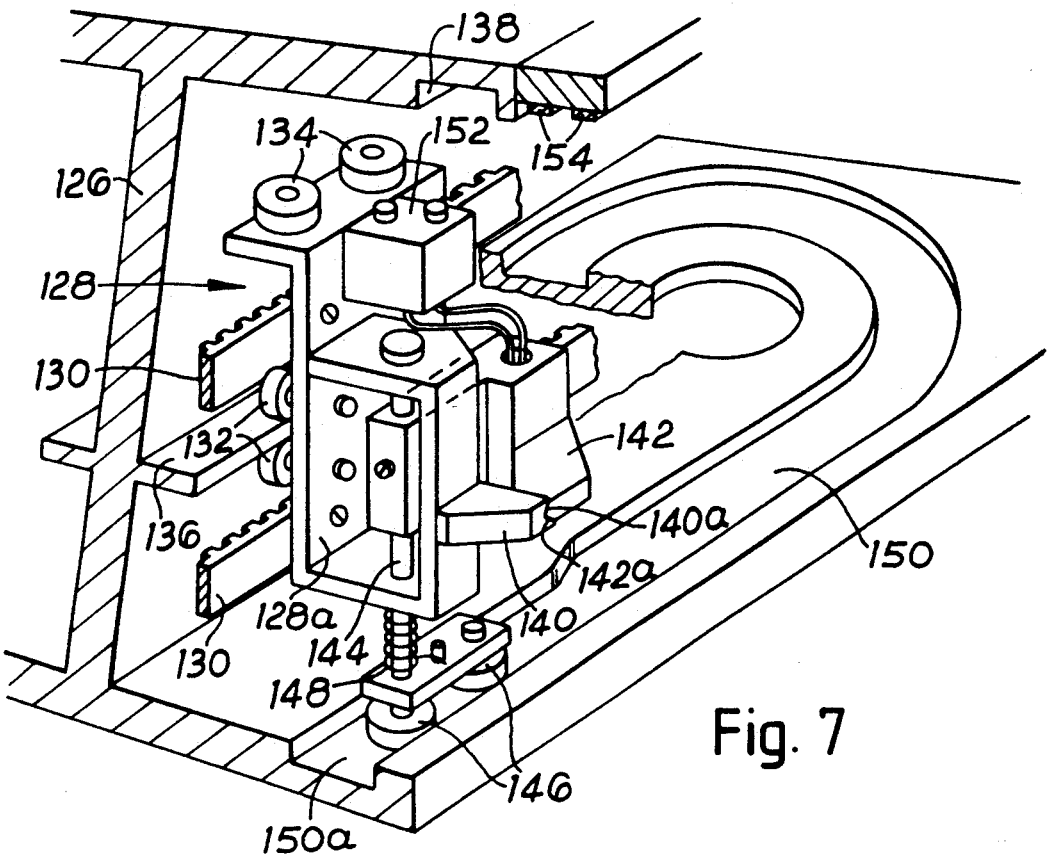
FIGS. 7 and 8 show details from FIG. 6 to a larger scale, of the tail folding and tail pressing units.
Figure 8:
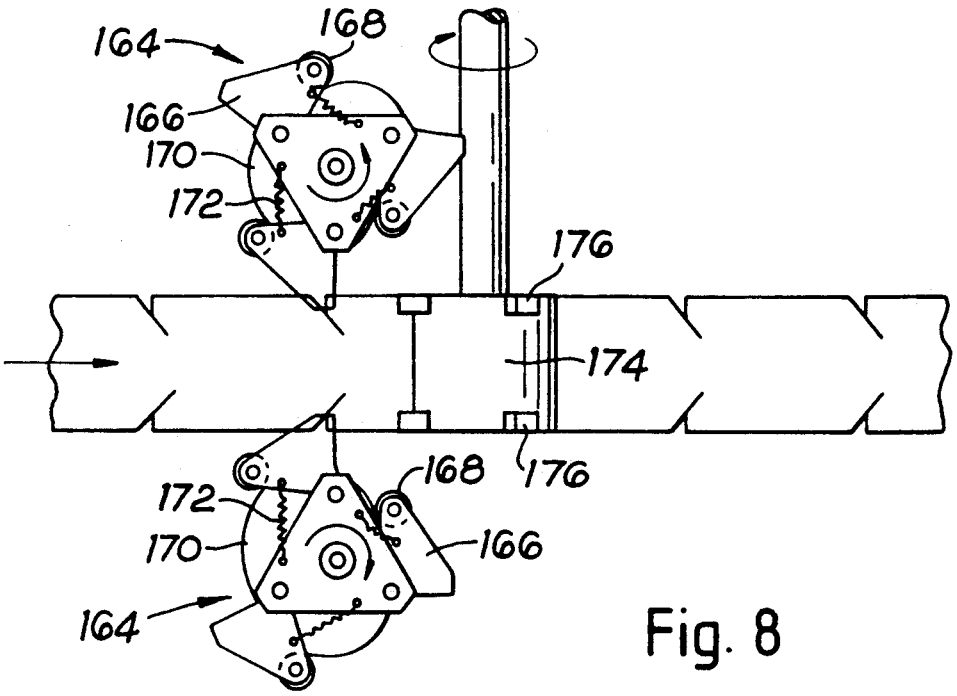

The securing of the compartments of the two webs together and the separation of pairs of compartments to form the individual tea-bags is carried out in a following section of the apparatus shown in FIG. 6. The webs travel from their end sealers to respective pairs of cutter and pressure rollers 118. These rollers partially sever the compartments from each other by cuts made from each side edge of the webs in the oblique heat seals that define the tapered portions of the tails and prepare these portions for the W-folds. The compartmented webs then travel on to a tail folding device 120 (FIGS. 6 and 7) which comprises a pair of opposed top and bottom belts 122,124 and opposite side frames 126 (one shown partly broken away) which each hold a circulating series of sealing carriers 128 secured to endless belts 130 driven in synchronism with the belts 122,124.

Each carrier 128 comprises a body 128*a* guided by rollers 132,134 running on a side rail 136 and in an upper guide slot 138 of the side frame 126. Projecting from the side of the body 128*a* is an anvil 140 which cooperates with a presser 142 mounted on a spindle 144 that pivots in the carrier 128. The spindle 144 projects downwards from the body and has at its lower end a pair of rollers 146 biased by a spring 148 against opposite faces of a cam track 150 in the side frame 128. By means of the cam track 150 the presser 142 is normally held clear of the anvil 140 but in a narrower region 150*a* of the cam track the spindle is pivoted to clamp a pair of severed tail portions of the respective webs between a recessed V-profile face 140*a* of the anvil and a complementary projecting V-profile face 142*a* of the presser. To heat seal the clamped tail portions together, the presser contains a cartridge heater (not shown) that is supplied with current at this stage through a brush unit 152 on the carrier contacting slip rings 154 fixed in the side frame.

In operation, the movements of the sealing carriers 128 in both side frames and of the belts 122,124 are synchronised. Initially, the anvil 140 and presser 142 of a carrier come between the two webs upstream of the belts 122,124 while the presser is held away from the anvil. The belts 122,124 carry projections 156 which then push the severed tail portions of the compartments into the gaps between each anvil 140 and its presser 142. The cam track 150 now causes the presser 142 to move between the projections 156 and to close against the anvil 142 clamping the adjacent tail portions in overlapping relationship. As the tail portions are clamped the carrier reaches the slip rings 154 so that the presser is heated and the clamped portions are welded together before the presser again separates from the anvil to allow the webs to exit to a tail pressing unit 160.

The tail pressing unit 160 comprises a pair of fixed, slowly converging guide channels 162 through which the heat sealed tail portions pass. At opposite sides of the webs, rotary tucker mechanisms 164 are provided to ensure that the welded portions are given a reflex fold, i.e. that they do not tend to flex rearwards, which would extend the overall length of the tea bags and disrupt subsequent processing. Each tucker mechanism 162 comprises a rotary boss 164 on which a plurality of tucker wings 166 are pivoted at equispaced angular intervals. Rollers 168 on the tucker wings 166 are held against the outer periphery of a fixed cam disc 170 by springs 172. As the wings 166 rotate with the boss 164 they enter the path of the interconnected webs 102*a*,102*b* and insert themselves between the webs in the regions of the welded tail portions.

As they pass through the path of the webs, the profile of the cam disc 170 causes the wings 166 initially to pivot in the direction of rotation of the boss 164 and then to pivot in the opposite direction. Thus, the wings 166 are accelerated as they enter between the webs so that they move forwards into the overlapped welded portions to tuck these in with the reflex fold shown in FIG. 4*c*, if the fold is not already there, and before the wings 166 leave the path of the web they are slowed so that they do not foul the web folds as they move out of the path.

While the wings 166 are inserted into the welded tail portions, these portions move further along the guide channels 160 and are sufficiently constrained by the narrowing channels to ensure that the folds are held. At the exit to the guide a pair of opposed upper and lower rollers 174 rotate and have elastic presser pads 176 which grip the folded tail portions between them to reinforce and finally stabilize the folds. The shaping of the tail seal portions is now retained without any further guidance.

The interconnected webs next enter a top joining device 180 comprising upper and lower belts 182,184 each carrying profiled heat sealing blocks 186 which are arranged to clamp upon the webs between the adjacent runs of the belts in register with the heat seals 48 made by the rollers 112 to make the heat seals 88 joining the webs at the top of the compartments. It is possible, alternatively to the device 180, to perform this function with heat seal rollers analogous to the rollers 112.

The heat seals 88 are narrower than the seals 48 so that the webs remain separate at the forward margin of the seal 48 between the W form seals of the tails. In this state the webs enter a top cutter 190 comprising pairs of upper and lower drive belts 192,194 gripping the already severed side portions of the formed tea bags, and between the pairs of belts a cutter wheel 196 which severs the remaining connections of the webs between successive pairs of compartments to form the separate dual compartment tea-bags. If the thread and tags (not shown) have been attached to the one web in a continuous string, the cutter wheel can simultaneously cut the thread at each line of severance between the bags.

Figure 9:
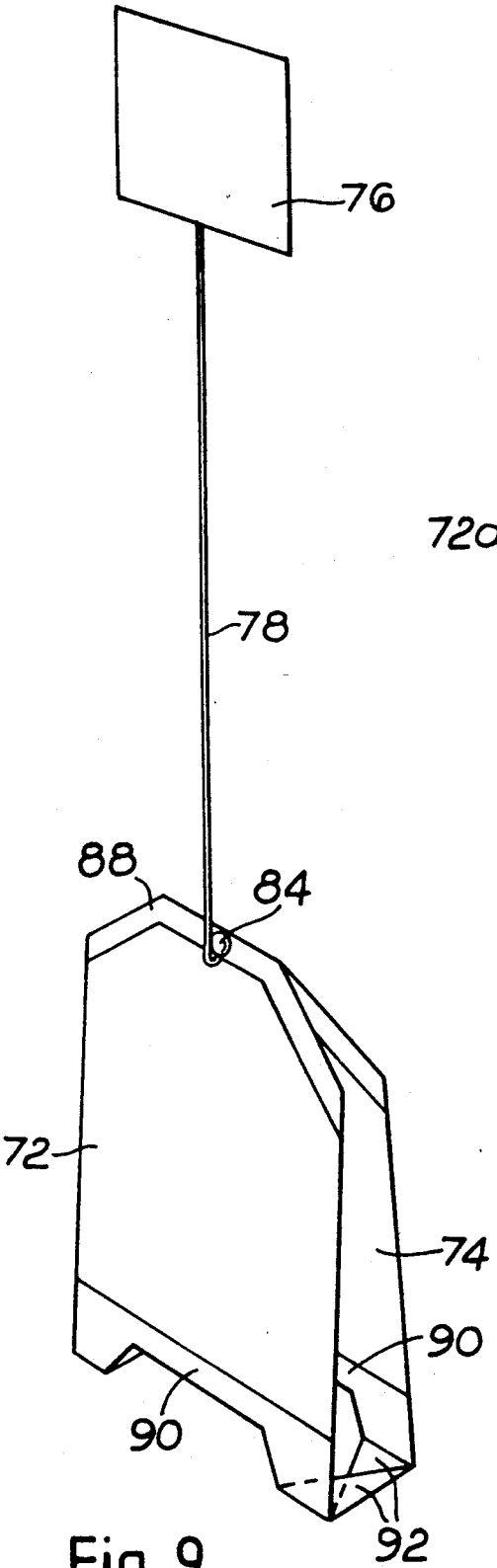
FIGS. 9 and 10 show modified forms of the tea bag in FIG. 3.

FIG. 9 illustrates a modified form of the tea bag in FIG. 3. Corresponding features are indicated by the same reference numbers and it will be noted that the two tea bags differ in the manner of interconnection of the compartments at their heads. In this example the head interconnection extends only over the central regions of the head seals 88; over the sloping side regions of the head seals the two compartments remain unconnected. This feature also assists free circulation of the infusing liquid when the tea bag is immersed in it. The figure shows the overlapping of the tail side pieces before the forwards centre fold has been made to complete the W-profile.

The tag is shown attached to the tea bag of FIG. 9 only by its thread. The different arrangements of tag and thread can be used interchangeably in any of the examples.

A feature of all the illustrated embodiments so far is that the compartments are connected together at their tails only at the laterally outer regions in the oblique portions of the end seals. Such an arrangement allows the infusing liquid to circulate more easily through the immersed tea bag. The complementary form of the head and tail profiles avoids waste while allowing the head to retain a conventional shape with cutaway corners.

Figure 10:
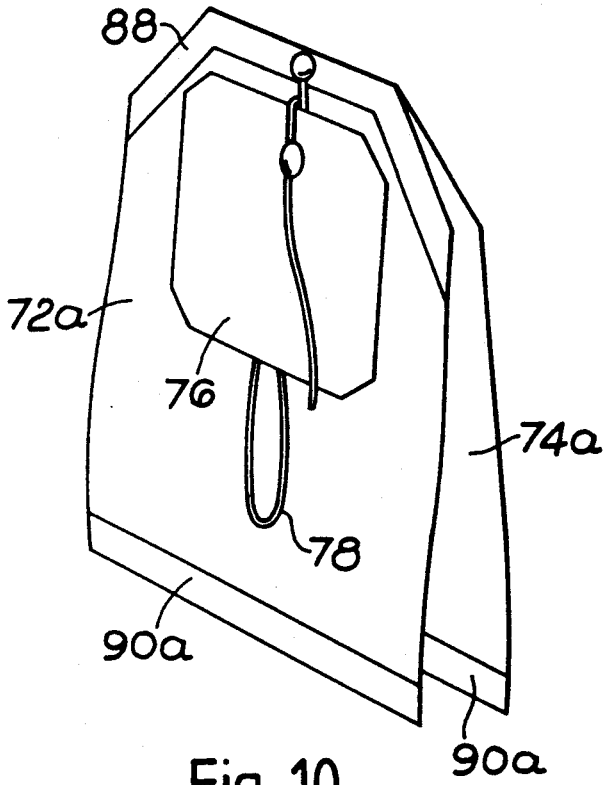

FIG. 10 illustrates another form of twin-compartment tea bag which can be produced by the method and apparatus of the present invention. It is connected only at the heads of the compartments 72*a*,74*a*, in the central region of the head seals 88 of the individual compartments as in the example of FIG. 9, but unlike the earlier examples it is not joined at the tails. The tail seals 90*a* of the compartments are not shown profiled, as they do not have single margin connections, but they can be given a complementary profile to the head seals. Because the compartments are not interconnected at their tails, the production of the tea bags is considerably simplified.

The use of heat sealable paper for the webs of the illustrated embodiments allows a relatively narrow overlap for the longitudinal seals and also eliminates the need for a folded and overlapped top closure or a securing tape such as is provided in known tea bags. A suitable grade of paper would be the 15.5 gsm double-sided heat-sealable filter paper made by Messrs J R Compton of Bury, Lancashire, GB and known as "Single Phase Superseal".

We claim:

1. A method of producing twin compartment packets, comprising the steps of dividing each of a pair of tubular webs along its length into a series of discrete compartments, locating said tubular webs in overlapping relationship with their compartments in register, joining the webs at the divisions between the compartments and, after said joining of the webs, severing the interconnected pairs of compartments from the webs as separate twin-compartment packets.

2. A method according to claim 1 wherein each tubular web is divided into said discrete compartments before the webs are brought into overlapping relationship.

3. A method according to claim 1 wherein the compartments of each said interconnected pair of compartments are joined at opposite ends.

4. A method according to claim 3 wherein the compartments of each said interconnected pair are joined at both opposite ends before separation of the pair of compartments from the webs.

5. A method according to claim 3 wherein the compartments of said interconnected pair are joined at one end only before separation of the pair of compartments from the webs, said pair of compartments opposite ends being joined at the end opposite said one end after the compartments are folded over about their join at said one end.

6. A method according to claim 1 wherein the compartments of each web are first separated from each other across part of their width and the registered pairs of compartments are connected together at the regions of partial separation before being severed from their respective webs.

7. A method according to claim 6 wherein said partial separation is effected before the two webs are joined together.

8. A method according to claim 6 wherein the compartments of each web are sealed from each other before said partial separation.

9. A method according to claim 1 wherein said joining of the webs at the divisions between the compartments forms an interconnection at one end of each interconnected pair of compartments that is folded into the length of said pair of compartments to give a generally W-form edge profile.

10. A method according to claim 9 wherein the compartments of each web are first separated from each other across part of their width and the W-form profile is imparted to portions of the compartments connected together at said regions of partial separation before the compartments are severed from their respective webs.

11. Apparatus for forming twin-compartment packets from a pair of compartmented webs, comprising means for feeding the webs in overlapping relationship with pairs of compartments of the respective webs in register, and means for connecting the pairs of compartments together at least at one end of each pair of mutually registered compartments and means for separating the connected pairs of compartments from the webs to produce the individual packets.

12. Apparatus according to claim 11 comprising means for partially separating the compartments of each web from each other before the webs are connected together, and means for connecting together registered pairs of compartments of the respective webs at their regions of partial separation, before said separation of said pairs of compartments from the webs to form the individual packets.

13. Apparatus according to claim 12 wherein said partial separation means produce severed opposite side margins of each of the webs.

14. Apparatus according to claim 12 comprising means for deflecting said regions of said partial separation of the registered compartments transversely to a path of said feed of the respective webs for bringing said regions into engagement to be sealed together for said connection at said regions of partial separation.

15. Apparatus according to claim 11 wherein means are provided for folding said sealed regions to put them between main regions of the registered compartments.

16. Apparatus according to claim 11 wherein respective means are provided for connecting the mutually registered pairs of compartments together at both ends.

17. Apparatus according to claim 11 wherein said means for connecting together the mutually registered pairs of compartments and for separating said pairs of compartments from the webs are arranged to operate on the compartmented webs while the webs are being continuously fed through the apparatus to said separating means.

* * * * *